US009956573B2

(12) United States Patent
Mansir

(10) Patent No.: US 9,956,573 B2
(45) Date of Patent: May 1, 2018

(54) SNOW AND ICE REMOVING APPARATUS

(71) Applicant: Darryl Mansir, Gardiner, ME (US)

(72) Inventor: Darryl Mansir, Gardiner, ME (US)

( * ) Notice: Subject to any disclaimer, the term of this patent is extended or adjusted under 35 U.S.C. 154(b) by 0 days. days.

(21) Appl. No.: 15/045,575

(22) Filed: Feb. 17, 2016

(65) Prior Publication Data

US 2016/0319549 A1 Nov. 3, 2016

Related U.S. Application Data

(60) Provisional application No. 62/155,176, filed on Apr. 30, 2015.

(51) Int. Cl.
*E01H 5/02* (2006.01)
*B05B 15/06* (2006.01)
*E04D 13/10* (2006.01)

(52) U.S. Cl.
CPC ..... *B05B 15/061* (2013.01); *E04D 13/103* (2013.01)

(58) Field of Classification Search
CPC . E04D 13/0762; E04D 13/106; E04D 13/103; B05B 15/061; E01H 5/02
USPC ..... 222/174, 565; 15/236.01–236.09; 294/54.5; 37/285, 278
See application file for complete search history.

(56) References Cited

U.S. PATENT DOCUMENTS 370,004 A * 9/1887 Bruner ..... B65G 65/24 222/166
992,871 A * 5/1911 Harvey ..... E01H 5/06 294/54.5
2,799,964 A * 7/1957 Childs ..... B05B 11/041 222/174
3,145,880 A 8/1964 Whatley
4,317,750 A * 3/1982 Provance ..... H01L 27/013 106/1.05
4,848,819 A * 7/1989 Moorefield ..... E01H 5/02 294/54.5
5,067,197 A * 11/1991 Cormier ..... A47L 13/11 15/244.1
5,159,769 A * 11/1992 Odorisio ..... E01H 5/02 294/54.5
5,464,481 A * 11/1995 Lietz, Jr. ..... A46B 9/02 134/6
6,578,890 B1 * 6/2003 Gilmore ..... E04D 13/106 294/53.5
6,964,353 B1 11/2005 Lamerson
(Continued)

*Primary Examiner* — Charles P Cheyney
(74) *Attorney, Agent, or Firm* — Global Intellectual Property Agency, LLC; Jordan Sworen

(57) ABSTRACT

An apparatus for removing snow and ice from rooftops and walkways. The apparatus includes an elongated shaft having a first end and a second end, with a length adjustment mechanism. The first end of the shaft is configured to be gripped by a user, wherein the second end includes a fastener for removably securing a dispenser or a scraper thereto. The dispenser includes a container for receiving ice melting material therein and a cap removably covering an open end of the container. The cap includes a plurality of apertures that can dispense the ice melting material therethrough. A user operates the apparatus to dispense the ice melting material in normally inaccessible areas, such as roofs. The scraper includes a body that can break apart large formations of ice and an overhang that can be used to scrape off the broken pieces of ice from the difficult to reach areas.

5 Claims, 3 Drawing Sheets

(56) References Cited

U.S. PATENT DOCUMENTS

| | | | | |
|---|---|---|---|---|
| 7,076,916 | B2 * | 7/2006 | Bianchini | A01M 1/2038 222/174 |
| 7,695,036 | B2 * | 4/2010 | Smetana | E01H 5/02 15/245 |
| 8,100,447 | B2 * | 1/2012 | DeWinter | E01H 5/02 294/51 |
| 2004/0256412 | A1 | 12/2004 | Meyer | |
| 2006/0231575 | A1 | 10/2006 | Sroufe | |
| 2010/0025496 | A1 * | 2/2010 | Fitzsimons | A01G 25/14 239/377 |

* cited by examiner

SNOW AND ICE REMOVING APPARATUS

CROSS REFERENCE TO RELATED APPLICATION

This application claims the benefit of U.S. Provisional Application No. 62/155,176 filed on Apr. 30, 2015. The above identified patent application is herein incorporated by reference in its entirety to provide continuity of disclosure.

BACKGROUND OF THE INVENTION

The present invention relates to snow and ice removing apparatuses. More specifically, the present invention provides an apparatus for dispensing ice melting material on difficult to reach areas so as to melt ice, as well as providing a scraper for breaking apart and removing large formations of ice.

Ice and snow buildup on a roof can be problematic for a home or building owner. Ice buildup creates a hazardous situation as the ice melts and falls to a ground surface, potentially injuring a person standing therebeneath. Further, some roofs are unable to withstand the weight of large amounts of snow and ice resting thereon for an extended period of time. Therefore, in order to remove the ice and snow, home and building owners often have to use a ladder to reach the ice buildup on top of roofs. Supporting a ladder on a potentially icy surface creates a further hazard and risk of injury due to the potential of the ladder slipping or an individual falling therefrom.

Further, ice and snow buildup on the roof of a vehicle, such as a van or truck, is difficult to reach. Some individuals choose to drive their vehicle without proper removal of such snow and ice, causing hazardous road conditions for other drivers as chunks of ice fall off the vehicle and block a driver's line of vision or cause damage to a vehicle. Conventional snow melting methods require the sole use of salt or other ice melting chemicals. However, removing a large buildup of snow and ice requires an alternative, faster-working device. Therefore, there exists a need for an ice melting apparatus that allows a user to conveniently remove ice buildup on rooftops and other difficult to reach areas, as well as melt the snow and ice.

Devices have been disclosed in the prior art that relate to snow and ice removing apparatuses. These include devices that have been patented and published in patent application publications. These devices generally relate to an ice melting material dispensing device secured to an elongated shaft for accessing gutters. These prior art devices have several known drawbacks. The devices in the prior art provide a means for dispensing ice melting material in difficult to reach areas. However, these devices fail to provide a scraper for breaking apart large amounts of ice and snow buildup and allowing for the convenient removal of such broken pieces from a roof.

In light of the devices disclosed in the prior art, it is submitted that the present invention substantially diverges in design elements from the prior art and consequently it is clear that there is a need in the art for an improvement to existing snow and ice removing apparatuses. In this regard the instant invention substantially fulfills these needs.

SUMMARY OF THE INVENTION

In view of the foregoing disadvantages inherent in the known types of snow and ice removing apparatuses now present in the prior art, the present invention provides a new snow and ice removing apparatus wherein the same can be utilized for providing convenience for the user when removing snow and ice from difficult to reach areas, such as the rooftop of a home or building.

It is therefore an object of the present invention to provide a new and improved snow and ice removing apparatus that has all of the advantages of the prior art and none of the disadvantages. The apparatus includes an elongated shaft having a first end and a second end, with a length adjusting mechanism. The first end of the elongated shaft is configured to be gripped by a user, wherein the second end includes a fastener adapted to be removably secured to a dispenser or a scraper to be removably secured thereto. The dispenser comprises a container for receiving ice melting material therein and a cap removably covering an open end on the container. The cap includes a plurality of apertures configured to dispense the ice melting material therethrough. A user operates the apparatus to dispense salt in normally inaccessible areas, such as roofs. The scraper is configured to break apart large formations of ice and scrape off the broken pieces of ice from the unreachable areas. The scraper and dispenser each include an opening for removably receiving the second end of the elongated shaft therein.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
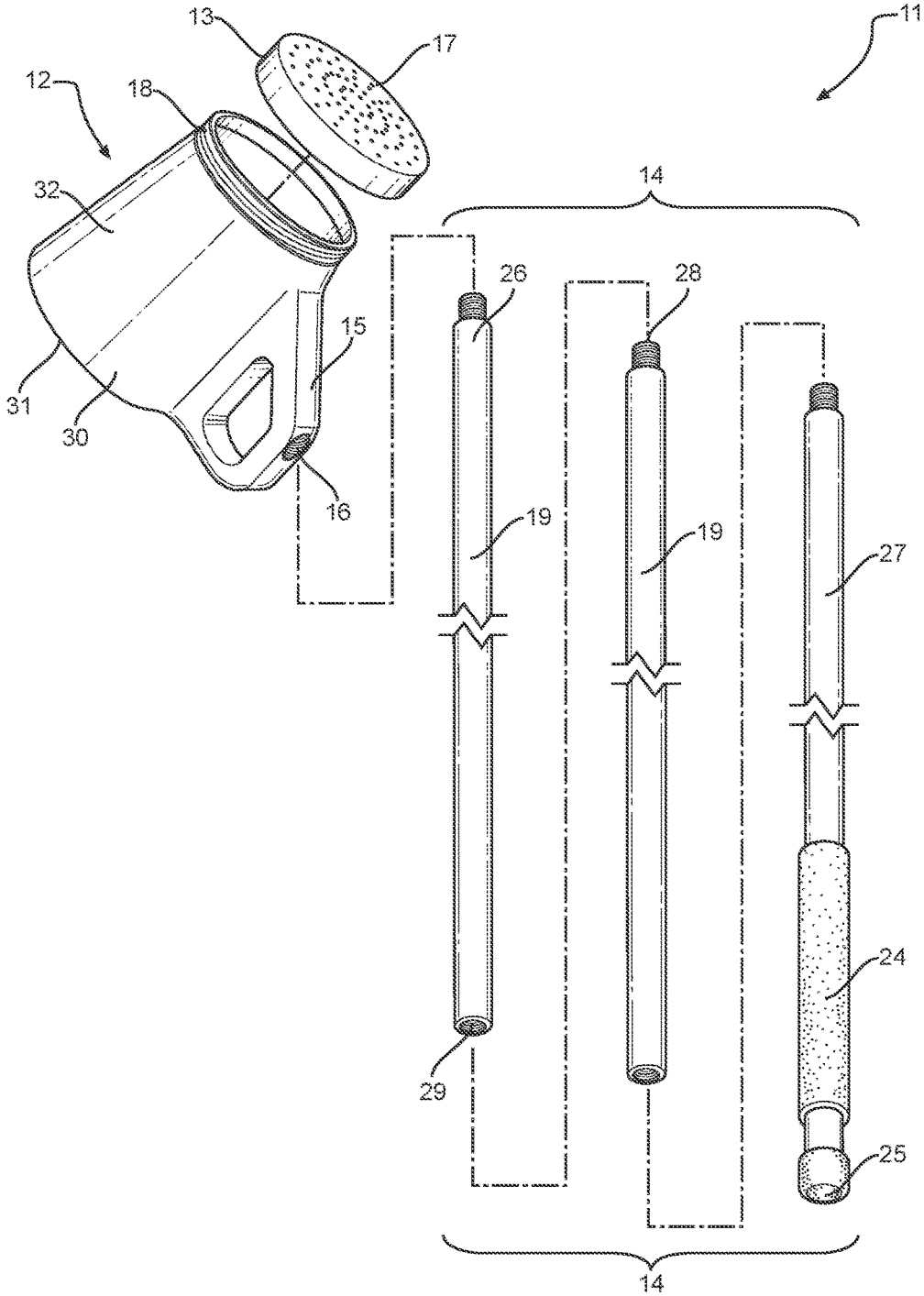
FIG. 1 shows an exploded view of the dispenser and the elongated shaft of the present invention.

Reference is made herein to the attached drawings. Like reference numerals are used throughout the drawings to depict like or similar elements of the snow and ice removing apparatus. For the purposes of presenting a brief and clear description of the present invention, the preferred embodiment will be discussed as used for removing snow and ice from difficult to reach areas, such as a rooftop of a home or building. The figures are intended for representative purposes only and should not be considered to be limiting in any respect.

Referring now to FIG. 1, there is shown an exploded view of the dispenser and the elongated shaft of the present invention. The snow and ice removing apparatus 11 comprises an elongated shaft 14 having a first end 25 and a second end 26, wherein the first end 25 is configured to be gripped by a user. In the illustrated embodiment, the first end 25 of the elongated shaft 14 comprises a padded, tubular grip 24 disposed therearound in order to provide comfort to the user as the shaft 14 is gripped. The second end 26 of the elongated shaft 14 is securable to a dispenser 12 and a scraper via a fastener. The elongated shaft 14 provides the user with an extended reach so as to allow the user to reach elevated areas, such as rooftops, and other hard to reach areas.

The elongated shaft 14 comprises a length adjusting mechanism in order to allow the elongated shaft 14 to extend and retract. In the illustrated embodiment, the elongated shaft 14 comprises an end rod 27, serving as the first end 25 of the elongated shaft 14. The elongated shaft 14 further comprises one or more secondary rods 19 removably securable to the end rod 27 and to one another in order to adjust the length of the elongated shaft 14. The end rod 27 comprises a threaded protrusion 28 extending from a first end thereof for removably securing to a threaded opening 29 disposed on a second end of a secondary rod 19. Each of the secondary rods 19 comprise a threaded opening 29 on a second end thereof and a threaded protrusion 28 on an opposing, first end thereof. Thus, a plurality of secondary rods 19 can be removably secured to one another in an end-to-end fashion. However, in other embodiments, any of various types of length adjusting mechanisms, such as a telescopic elongated shaft, can be utilized in order to adjust the length of the elongated shaft. It is not desired to limit the specific type of length adjusting mechanism.

The second end 26 of the elongated shaft 14 is securable to the dispenser 12 adapted to dispense ice melting material therefrom, such as sodium chloride, calcium chloride, or magnesium chloride. The dispenser 12 comprises a container 30 defining an interior volume and an open end configured to receive the ice melting material therein. In the illustrated embodiment, the container 30 comprises a base 31, an open upper end 18, and a sidewall 32 extending therebetween. In the illustrated embodiment, the container 30 comprises a circular cross section. However in alternate embodiments, the container 30 comprises any suitable shaped cross section, such as a rectangle.

A handle 15 extends outwards from the sidewall 32 of the container 30, wherein the handle 15 is adapted to be held by a user when the dispenser 12 is not attached to the elongated shaft 14. Thus, the dispenser 12 can be used to dispense ice melting material on walkways and the like, as well as the difficult to reach areas when secured to the elongated shaft 14. The handle 15 comprises an opening 16 thereon for removably receiving the second end 26 of the elongated shaft 14 therein. The elongated shaft 14 is secured within the opening 16 of the dispenser 12 via any suitable fastener, such as a press fit or threading. In the illustrated embodiment, the fastener comprises the threaded protrusion 28 extending from the secondary rod 19 serving as the second end 26 of the elongated shaft 14.

A cap 13 removably covers the open upper end 18 of the container 30 and is removably securable thereto via a fastener, such as threading or a press fit. The cap 13 comprises a plurality of apertures 17 thereon, wherein each aperture 17 is configured to dispense the ice melting material stored within the container 30 therethrough. The cap 13 is dimensioned to cover the open upper end 18 of the container 30.

Figure 2:
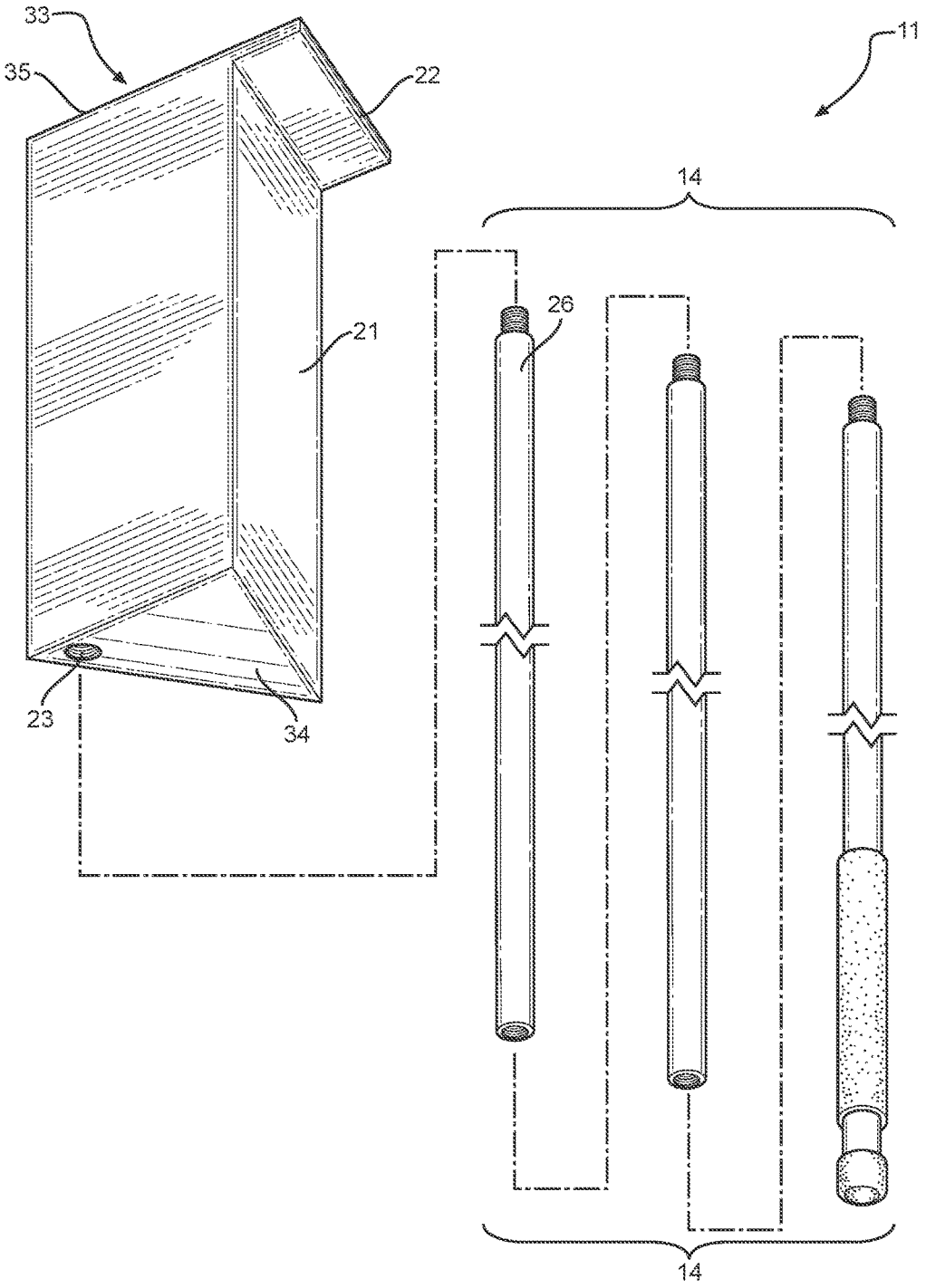
FIG. 2 shows an exploded view of the scraper and the elongated shaft of the present invention.

Referring now to FIG. 2, there is shown an exploded view of the scraper and the elongated shaft of the present invention. The second end 26 of the elongated shaft 14 is further securable to the scraper 33. In the illustrated embodiment, the scraper 33 comprises a body 21 having a triangular cross section adapted to break up large formations of ice buildup that accumulate on rooftops. Preferably, the shape of the body 21 comprises one or more edges in order to allow a user to concentrate and direct the force caused by hitting the ice buildup in a specific direction. The body 21 of the scraper 33 is preferably composed of a durable material, such as hard plastic or metal. The body 21 of the scraper 33 further comprises an opening 23 for receiving the second end 26 of the elongated shaft 14 therein. In the illustrated embodiment, the opening 23 is disposed on a lower end 34 of the body 21. The elongated shaft 14 is secured within the opening 23 of the scraper 33 via any suitable fastener, such as a press fit or threading. In some embodiments, the second end 26 of the elongated shaft 22 extends through the body 21 of the scraper 33 by more than half the length of the body 21 in order to provide more leverage for the user when breaking up large formations of ice therewith.

The scraper 33 further comprises an overhang 22 extending from the body 21, wherein the overhang 22 is adapted to remove broken pieces of ice and snow by scraping a surface, such as a rooftop. In the illustrated embodiment, the overhang 22 extends perpendicularly outward from an upper end 35 of the body 21. The distal edge of the overhang 22 is linear so as to uniformly scrape a surface and remove snow and ice therefrom.

Figure 3:
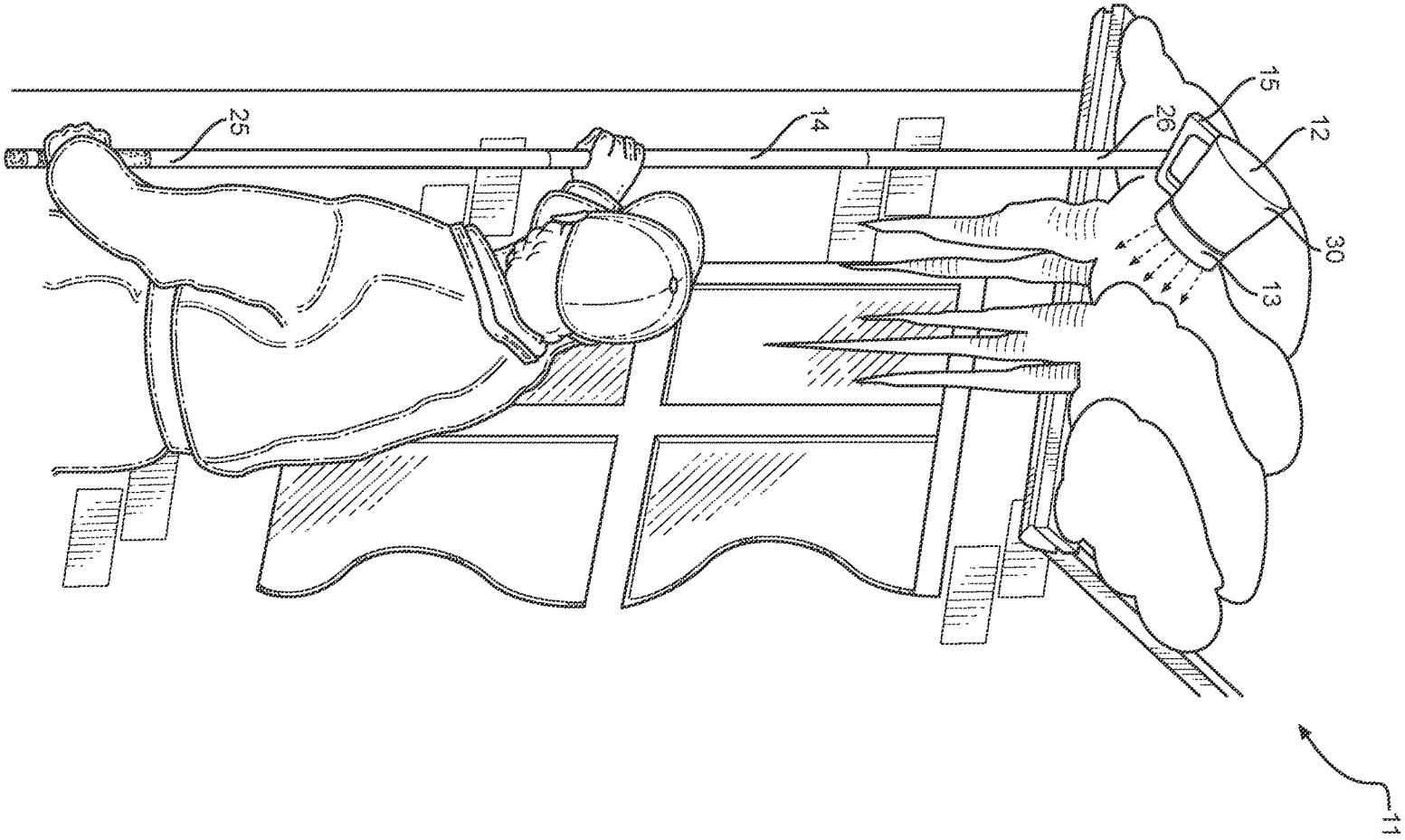
FIG. 3 shows a perspective view of the present invention in use.

Referring now to FIG. 3, there is shown a perspective view of the present invention in use. In operation of the snow and ice removing apparatus 11, a user secures one or more secondary rods to the end rod in order to achieve the desired length of the elongated shaft 14. The scraper is removably secured to the second end of the elongated shaft 14, wherein the body of the scraper is used to break up any buildup of ice by pounding or hitting the surface of the buildup. The user rotates the shaft 14 in order to align the overhang parallel to the broken pieces of ice. The user scrapes the rooftop or other surface using the overhang and removes snow and ice accumulation therefrom.

The user fills the container 30 of the dispenser 12 with ice melting material and secures the cap 13 thereto. The scraper is removed and replaced with the dispenser 12. The user distributes the ice melting material onto the roof by shaking or oscillating the first end 25 of the elongated shaft 14, thereby distributing the ice melting material from the dispenser 12 and onto the roof. The user can then remove the dispenser 12 from the elongated shaft 14 and distribute the remaining ice melting material onto a walkway by shaking or oscillating the handle 15 extending from the sidewall of the container 30. In some embodiments, the scraper is attached to the first end 25 of the elongated shaft 14 and the dispenser 12 is attached to the second end 26 of the elongated shaft 14.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A snow and ice removing apparatus, comprising:

an elongated shaft having a first end and a second end, wherein the first end is configured to be gripped by a user;

a dispenser removably securable to the second end of the elongated shaft comprising; a container defining an interior volume and an open end configured to receive ice melting material therein;

a cap removably covering the open end of the container, wherein the cap comprises a plurality of apertures thereon and configured to dispense the ice melting material disposed within the container;

wherein the plurality of apertures are configured to be disposed at an acute angle relative to the elongated shaft when the dispenser is removably secured to the second end of the elongated shaft, such that the ice melting material can be dispensed when the elongated shaft is in a vertical position;

wherein the dispenser is removed from the elongated shaft, and replaced with a scraper, or vice versa;

the scraper being removably secured to the second end of the elongated shaft, wherein the scraper comprises a body having a triangular cross-section perpendicular to a longitudinal axis of the elongated shaft;

wherein the triangular cross-section defines a plurality of striking edges configured to direct force therethrough when the body is struck against an ice formation;

an opening disposed on a lower side of the body for removably receiving the second end of the elongated shaft therein via a threaded fastener, wherein the opening is configured to receive the elongated shaft therein such that the elongated shaft extends through at least half of a length of the body; and an overhang extending from a first side of the body, wherein the first side is disposed opposite the opening.

2. The snow and ice removing apparatus of claim 1, wherein the elongated shaft comprises an end rod and one or more secondary rods, wherein the end rod is disposed on the first end of the elongated shaft and removably secured to one or more secondary rods for adjusting a length of the elongated shaft.

3. The snow and ice removing apparatus of claim 1, wherein the dispenser comprises a handle extending from the container.

4. The snow and ice removing apparatus of claim 3, wherein the dispenser comprises an opening on the handle for removably receiving the second end of the elongated shaft therein.

5. The snow and ice removing apparatus of claim 1, wherein the overhang extends perpendicularly outwards from an upper end of the body.

* * * * *